US005353704A

United States Patent [19]

Canto

[11] Patent Number: 5,353,704

[45] Date of Patent: Oct. 11, 1994

[54] STAMPING APPARATUS AND METHOD FOR FORMING A STAMP AND STAMPING USING ELONGATED MEMBERS

[75] Inventor: Karen J. Canto, Sonora, Calif.

[73] Assignee: WildeWood Creative Products, Inc., Sonora, Calif.

[21] Appl. No.: 89,731

[22] Filed: Jul. 9, 1993

[51] Int. Cl.[5] ..... B41F 17/00

[52] U.S. Cl. ..... 101/372; 101/111; 101/327; 101/373

[58] Field of Search ..... 101/372, 373, 333, 327, 101/110, 111, 376, 379, 380; 401/197

[56] References Cited

U.S. PATENT DOCUMENTS

| | | | |
|---|---|---|---|
| 1,231,505 | 6/1917 | Denney | 101/380 |
| 3,063,371 | 11/1962 | Lowell et al. | 101/380 |
| 4,271,759 | 6/1981 | Volk | 101/110 |
| 4,432,281 | 2/1984 | Wall et al. | 101/104 |
| 4,561,353 | 11/1985 | Chapman et al. | 101/111 |
| 4,690,053 | 9/1987 | Munyon et al. | 101/405 |
| 4,744,295 | 5/1988 | Volk | 101/111 |
| 5,133,254 | 7/1992 | Kirkwood | 101/372 |

*Primary Examiner*—Edgar S. Burr
*Assistant Examiner*—Lynn D. Hendrickson
*Attorney, Agent, or Firm*—Blakely, Sokoloff, Taylor & Zafman

[57] ABSTRACT

A stamp and a method for stamping is described in which rubberbands are placed on to a stamp body. One of the side surface of the stamp body is then pressed onto an ink pad. The surface of the stamp body is pressed onto a media so as to produce an image on the media. Any of a number of different geometry's of stamp bodies and rubberbands may be used to form a variety of images. The stamp body has grooves formed within it such that the rubberbands may be secured to the stamp body. Multi-colored images and patterns may be formed by using either multi-colored stamp pads or making multiple images by using a number of stamp pads having different colors.

30 Claims, 13 Drawing Sheets

STAMPING APPARATUS AND METHOD FOR FORMING A STAMP AND STAMPING USING ELONGATED MEMBERS

BACKGROUND OF THE INVENTION (1) Field of the Invention

The present invention relates to the field of printing devices and more particularly, to a stamping apparatus and a method for forming a stamp and a method for forming an image on a media.

(2) Prior Art

A hand-stamp stamping apparatus typically forms an image on a media such as a piece of paper by first pressing a stamp surface on which an image is formed into a pad containing ink. The stamp surface is then pressed onto the piece of paper so as to form an image. Typically, an image is formed upon the surface of the stamp by engraving or etching one of the sides of the stamp. The stamp surface may also be formed by etching, engraving or molding a thin strip of material so as to form an image on the strip. The strip is then affixed to the stamp. Each stamp typically has only one image formed on a single surface of the stamp for stamping. As only one image is typically contained on any given stamp surface, it is not uncommon to use a large number of stamps for forming complex decorative images. Prior art methods for using one stamp to create more than one stamped image have included the use of stamps having multiple stamp surfaces. However, the image formed on the stamp surface is usually permanent. Therefore, the number of images which may be formed is limited by the number of stamp surfaces. One prior art method for forming a plurality of images using a single stamp involves the use of movable gears which expose any of a number of different images. This type of apparatus is commonly used for date-stamping documents. Other than this type of multiple image stamping machines, most stamps have only one image formed on the stamp surface or placed onto a given stamp surface. What is needed is a stamping apparatus and a method for stamping which will allow for multiple images to be created on a single stamp surface which may include multiple stamp surfaces.

SUMMARY OF THE INVENTION

An apparatus and method for forming a stamp using rubberbands is described. In the first embodiment of the present invention a stamping apparatus having a number of pegs formed at either end of the apparatus is shown. These pegs allow for rubberbands to be inserted such that the rubberbands extend across the side surfaces of the stamp body so as to form stamp surfaces. The rubberbands may be arranged in any of a number of ways in order to form different images. Typically, only one of the side surfaces of the stamping apparatus is used at a given time for forming an image; however, any of the different side surfaces could be used. In addition, more than one or all of the side surfaces could be used to form images after a given placement of rubberbands. In this manner, a stamp may form several different images, dependent on which stamp surface is used and dependent on the placement, size, and number of rubberbands.

After the desired number of images have been created by using a given stamp, the rubberbands may be removed from the stamp body. The rubberbands may then be placed again on to the stamp body in such a manner that a number of different stamp surfaces are formed. These different stamp surfaces may then be used to form additional images. In this manner, any of a number of different images may be formed by using a single stamp body in combination with one or more rubberbands.

In a second embodiment of the present invention a thinner stamp body is disclosed for creating borders or forming narrow images. A single rubberband may be placed onto the stamp body for creating a linear stamp and corresponding images. Additional rubberbands may also be placed on the stamp body so as to create a number of different stamp surfaces and corresponding images. A third embodiment is disclosed which includes a rotatable stamp surface and a handle. In this embodiment, rubberbands are placed onto a cylindrical stamp body so as to create a stamp surface which may be rotated about its central axis so as to produce a stamped image. A fourth embodiment is disclosed which has a circular stamp surface and a handle.

BRIEF DESCRIPTION OF THE DRAWINGS

The present invention is illustrated by way of example and not limitation in the figures in the accompanying drawings and in which like numbers indicate similar elements and in which.

DETAILED DESCRIPTION OF THE INVENTION

In the following description numerous specific details are set forth such as dimensions, materials, thicknesses, etc., in order to provide a thorough understanding of the present invention. However, it will be obvious to one skilled in the art that the invention may be practiced without the specific details. In other instances well known processing techniques, materials, etc. have not been shown in detail in order to avoid unnecessarily obscuring the present invention.

Figure 1:
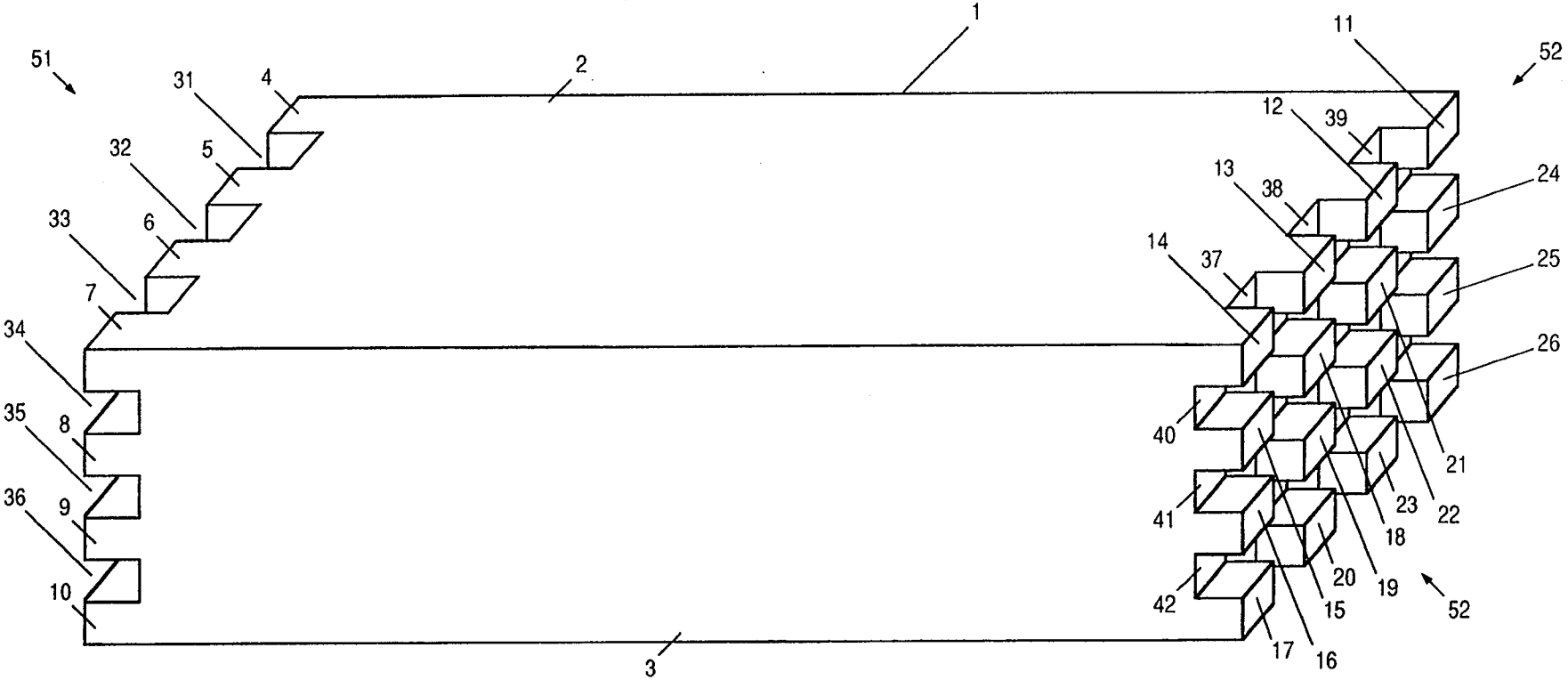
FIG. 1 is a isometric view of the stamp body of the first embodiment of the present invention.

FIG. 1 illustrates an isometric view of the first embodiment of the present invention. FIG. 1 shows a schematic view of a stamp body. This body may be made from wood, plastic, or metal, for example. The first embodiment is illustrated with reference to a stamp body which is made of wood. Wood is preferably used since it is inexpensive and easy to shape. The stamp body may be manufactured by taking a block of wood and making cuts within surfaces of the block so as to create grooves and/or pins. Though this and the following embodiments are illustrated with reference to the use of grooves and pins, other methods for securing the rubberbands such as pegs, screws, clips, etc. to the body may be used. Furthermore, this and the other embodiments are illustrated with reference to standard off the shelf rubberbands. However, any type of elongated flexible shape could be used. For example, elastic strips having the shape of an animal image formed on a portion of the strip could be used. Cuts within top surface 51 forms groove 31, groove 32, and groove 33. Cuts may then be made so as to form groove 34, groove 35, and groove 36. These cuts will form pins 4–10 and a number of other pins which are not shown. Similar cuts are made within the opposite end of the body, or the bottom surface 52 of the stamp body 1 so as to form grooves and pins. Cuts within bottom surface 52 form grooves 37–42. Cuts which pass through the side surface 2 form groove 37, groove 38, and groove 39. Cuts which pass through the side surface 3 form groove 40, groove 41, and groove 42. These cuts form pins 11–26. In this manner, a stamp body may be formed easily and inexpensively.

Figure 2:
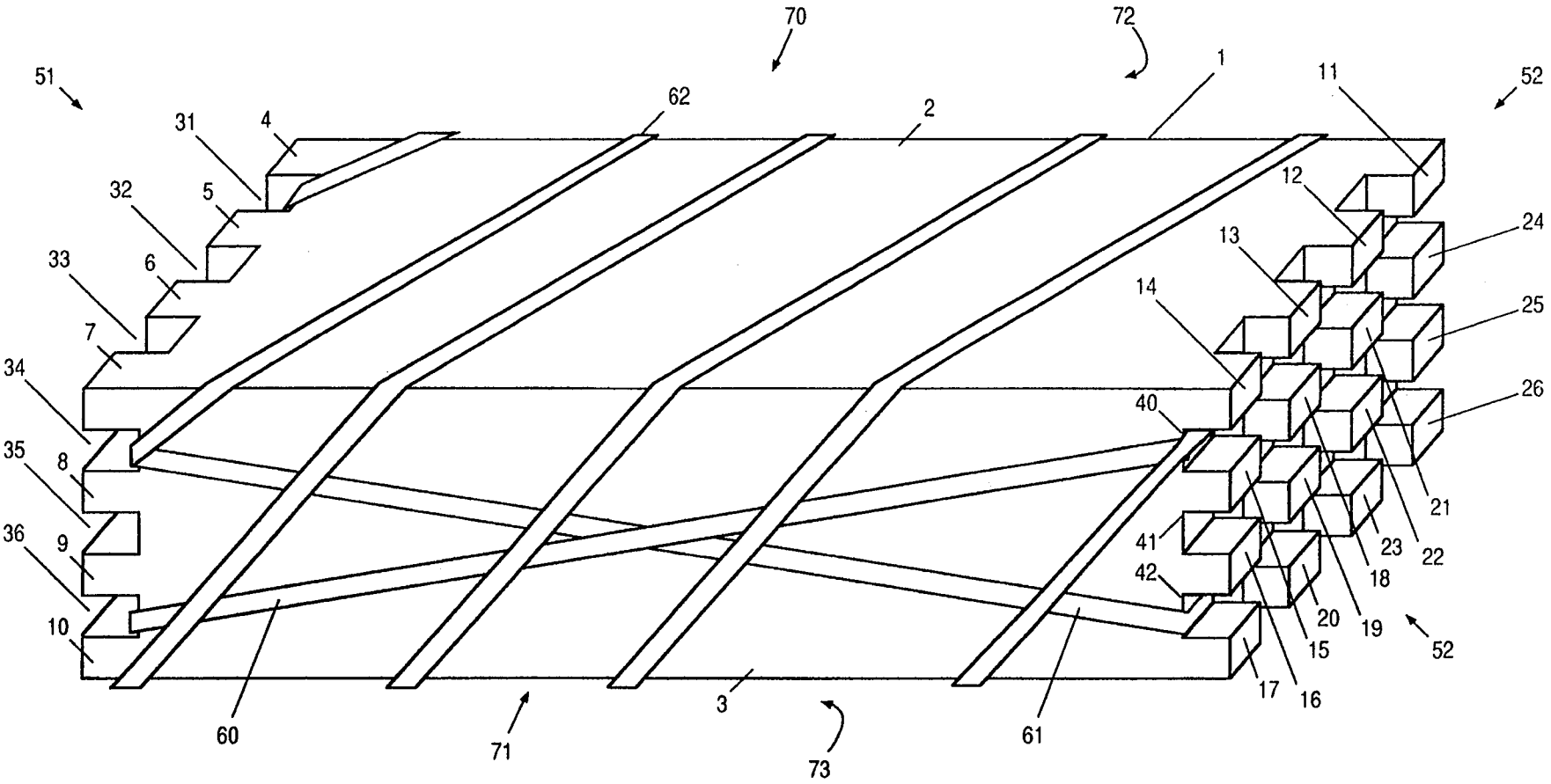
FIG. 2 is an isometric view of the stamp body of the first embodiment of the present invention after rubberbands have been placed onto the stamp body so as to form a stamp.

FIG. 2 illustrates the stamp body of FIG. 1 after stamping surfaces have been formed on the stamp body. The stamping surfaces are formed by placing rubberbands on the stamp body. First, rubberband 61 is placed onto the stamp body such that the rubberband is secured within groove 34 and groove 42. Rubberband 60 is then placed diagonally across the stamp body such that groove 36 and groove 40 hold the rubberband securely onto the stamp body 1. Rubberband 62 which is a thinner and longer rubberband is then placed around the stamp body 1 in such a manner as to form diagonal lines across the side surfaces of the stamp. This will form stamp surface 70 which lies along side surface 2 of the stamp body 1 and stamp surface 71 which lies along the side surface 3. Note that the pins 4–26 hold rubberband 62 tightly onto the stamp body 1. The placement of stamps across the stamp body 1 forms stamping surfaces having patterns across all four side surfaces of stamp body 1. Similar patterns are formed on stamp surface 72 and stamp surface 73.

The formation of a stamping surface having a pattern is thus easily and quickly accomplished. Furthermore, a number of different stamping surfaces may be formed at any given time. Though this embodiment is described with reference to the use of three rubberbands, any number of rubberbands could be used. One with skill in the art would realized that any of a number of different patterns could be formed by the arrangement of rubberbands upon the stamp body 1. In fact, the number of different stamping surfaces and corresponding images which may be created is limited only by the imagination of the user. Different stamping surfaces and images may also be formed by twisting the rubberbands and by using elastic strips having specific shapes and varying lengths and thicknesses. These shapes could include the shapes of animals, people or other images.

Figure 3:
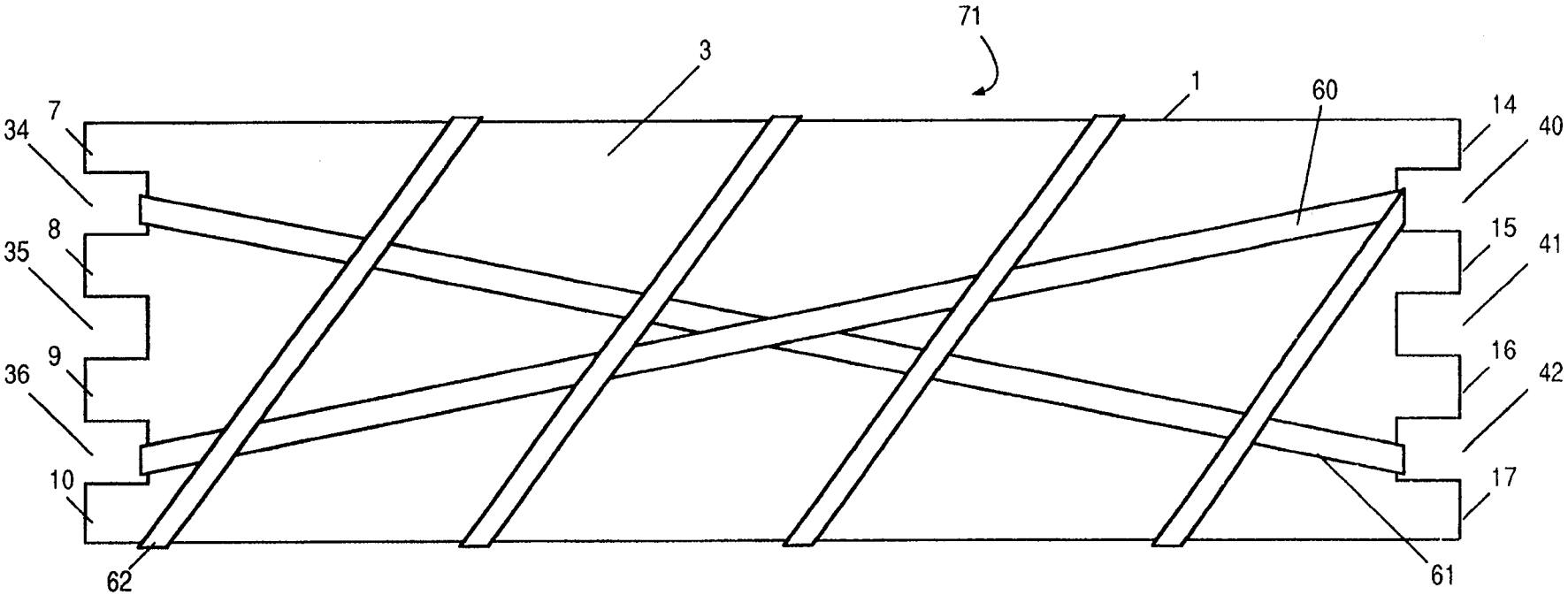
FIG. 3 is a view of the stamp surface formed by side surface 3 of the stamp shown in FIG. 2.

FIG. 3 illustrates the stamping surface 71 which is formed by the placement of the rubberbands as previously described with reference to FIG. 2. Stamping surface 71 is formed by the placement of rubberband 60, rubberband 61, and rubberband 62 upon the stamp body 1 such that the rubberbands overlie side surface 3. The stamp surface which is formed may be used to form an image having a pattern which corresponds to the placement of the rubberbands. Also shown are pins 7–10 and 14–17, and grooves 34–36 and 40–42.

Figure 4:
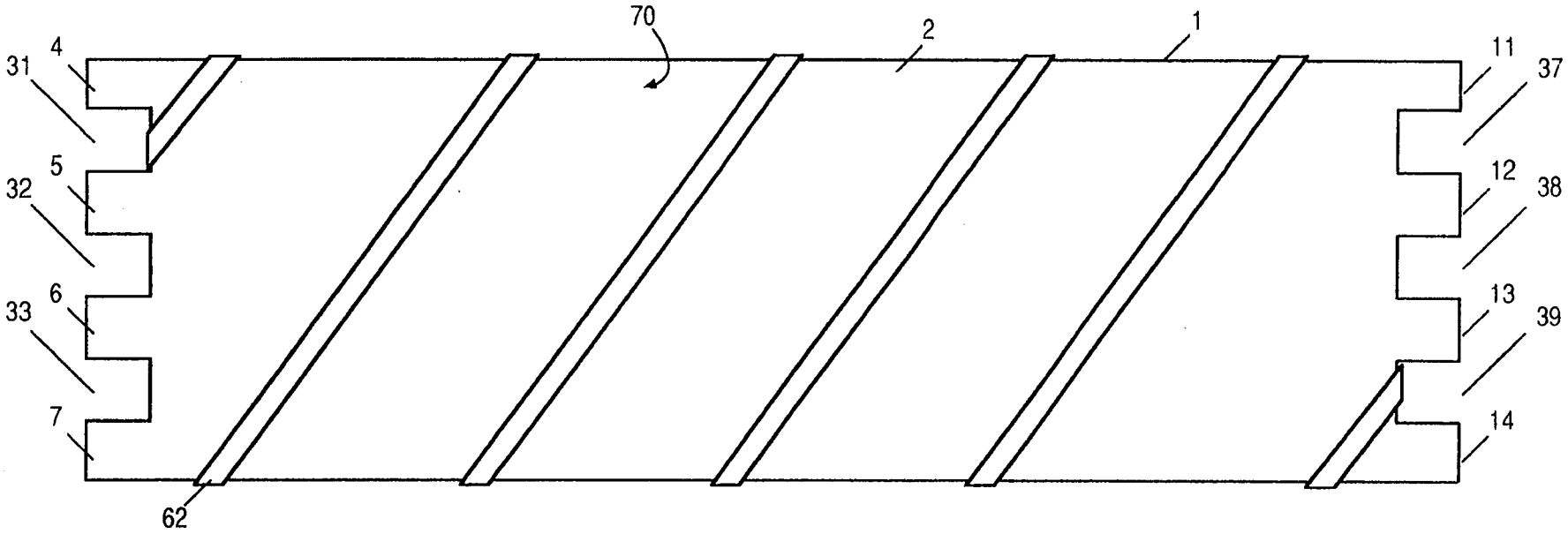
FIG. 4 is a view of one of the stamp surface formed by side surface 2 of the stamp shown in FIG. 2.

FIG. 4 illustrates the stamp surface 70 formed by the placement of rubberband 62 across top side surface 2 of stamp body 1. Note that a striped stamp surface is formed by the placement of the rubberband 62. Also shown are pins 4–7 and pins 11–14 and grooves 31–33, and 37–39. Note how pin 4 and groove 31 secure one end of the rubberband to the stamp body 1

Figure 5:
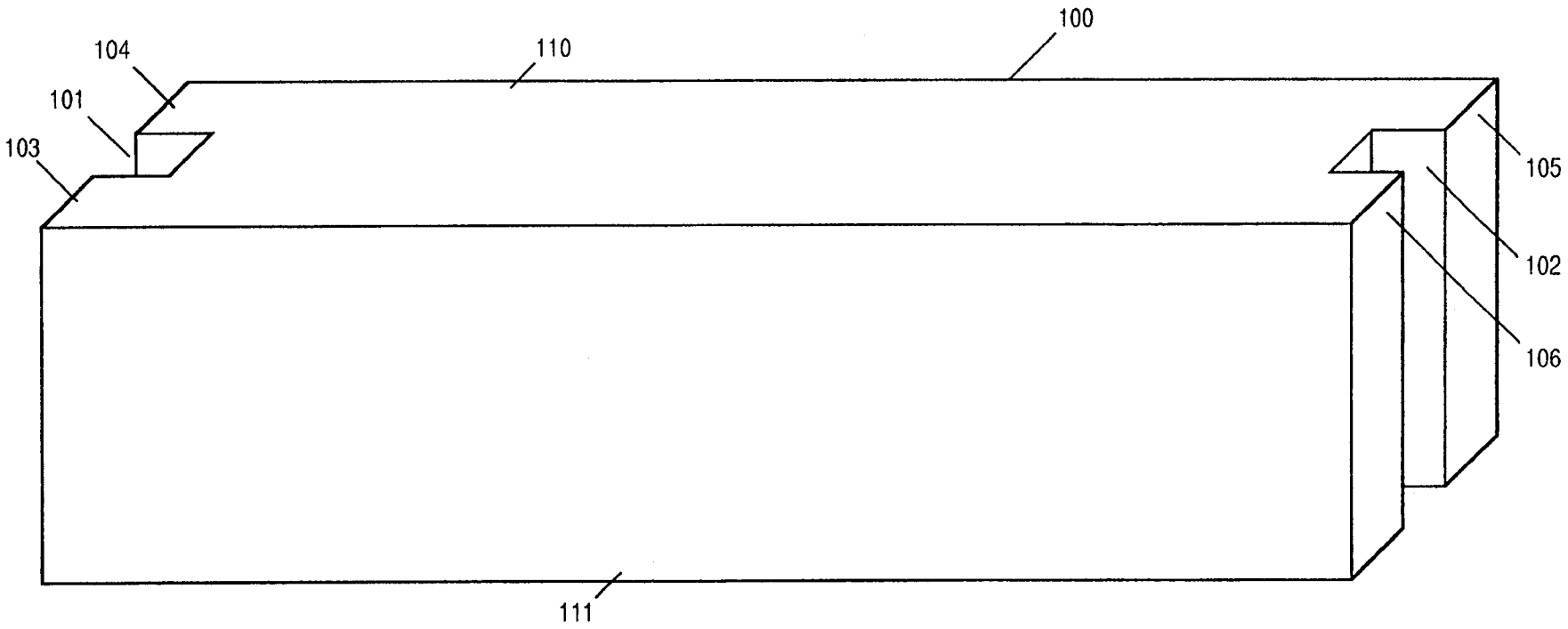
FIG. 5 is a isometric view of the stamp body of a second embodiment.

FIG. 5 shows a second embodiment of the present invention in which a stamp body 100 is formed by making cuts within a block so as to form groove 101. This creates ridge 103 and ridge 104 which lie on either side of the groove 101. Similarly a cut along the opposite edge of the stamp body 100 creates groove 102 and ridges 105 and 106. Side surface 110 and side surface 111 are also shown. As in the prior embodiment, the stamp body may be made from any number of materials; however, wood is preferably used as it is inexpensive and easy to cut.

Figure 6:
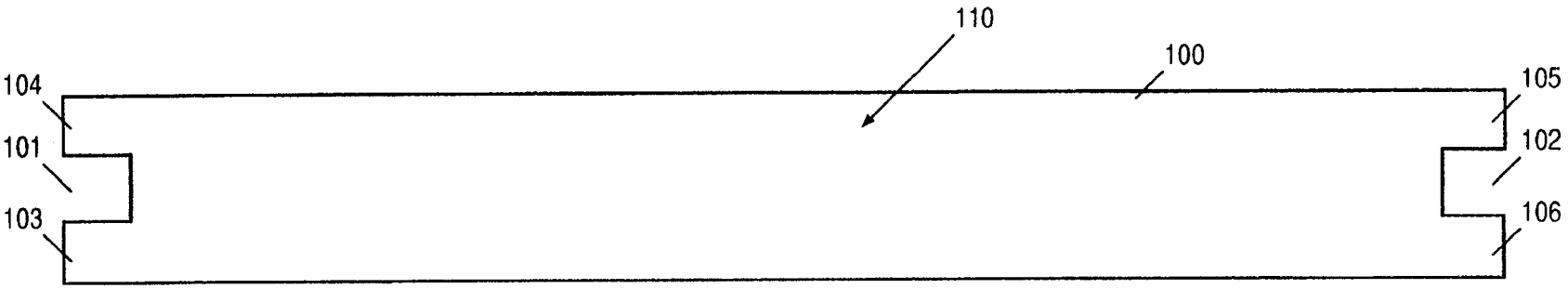
FIG. 6 is a top view of the stamp body of the second embodiment.

FIG. 6 illustrates the side surface 110 of the stamp body 100 shown in FIG. 5. Groove 101 is seen to lie between ridge 103 and ridge 104. Similarly, groove 102 lies between ridge 105 and ridge 106.

Figure 7:
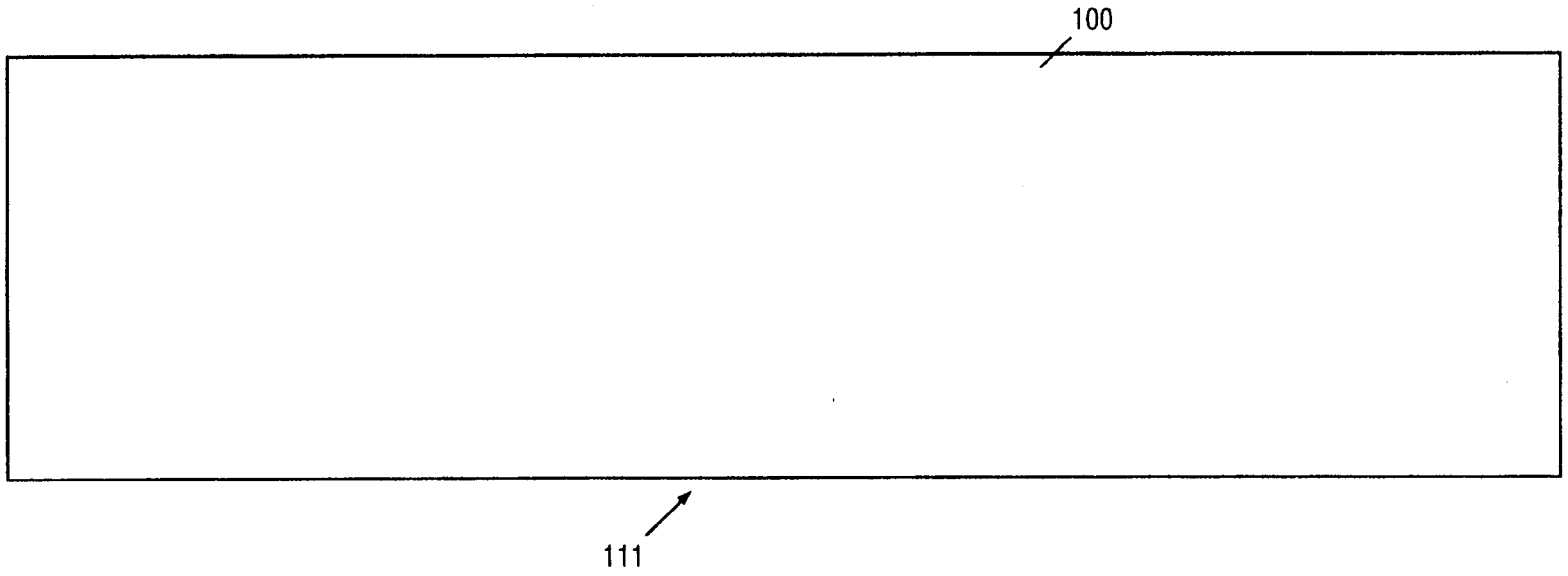
FIG. 7 is a side view of the stamp body of the second embodiment.

FIG. 7 shows side surface 111 of the second embodiment of the present invention. It can be seen that the side surface 111 of stamp body 100 does not have any grooves cut into the edges of the body which intersect side surface 111. However, alternate embodiments could have grooves cut into the edges of the side surface for securing rubberbands to the body.

Figure 8:
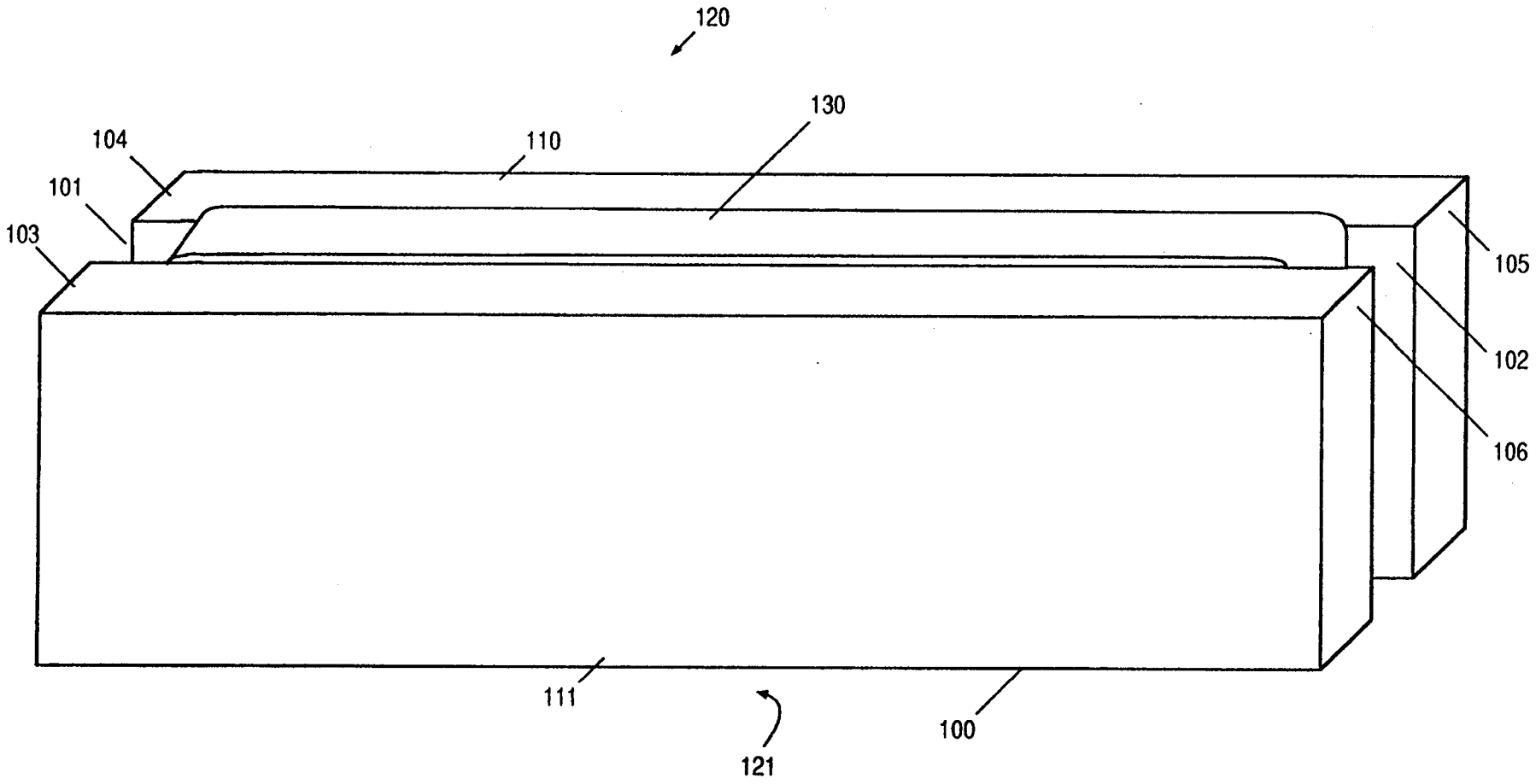
FIG. 8 is an isometric view of the stamp body of the second embodiment of the present invention having a rubberband attached thereto.

FIG. 8 shows the stamp body of FIGS. 5–7 after rubberband 130 has been placed onto stamp body 100 such that stamp surface 120 is formed over the top surface 110. An identical stamp surface, stamp surface 121 is formed on the opposite side of the stamp body. It can be seen that rubberband 130 is held securely within groove 101 and groove 102. The ridges 103–106 act to hold the rubberband securely onto stamp body 100. The stamp surface 120 which is formed by the placement of the rubberband onto the body 100 is shown to be a single linear band. However, by twisting the rubberband a scalloped effect may be created. In addition, additional rubberbands may be place across the body 100 similar to the placement of rubberband 70 in the first embodiment of the present invention so as to produce a more elaborate stamp surface. These rubberbands may be secured by either one, two, or all of the ridges 103–106.

Figure 9:
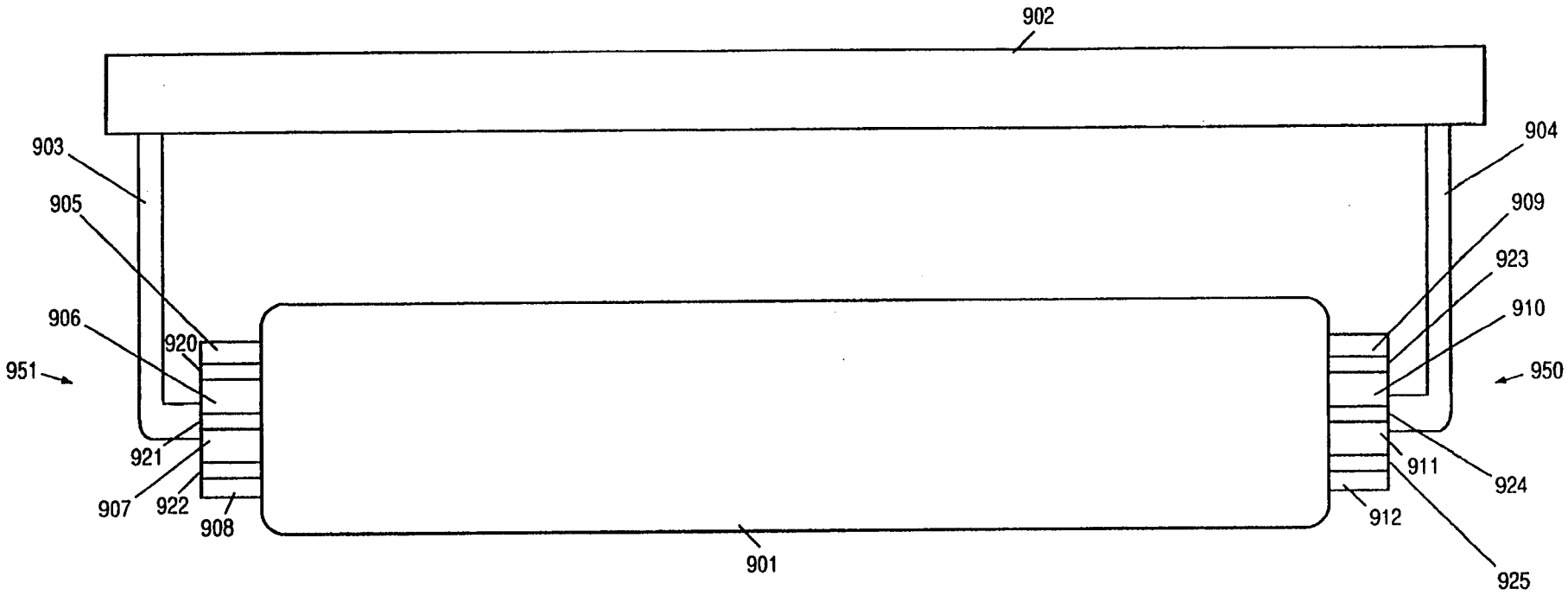
FIG. 9 shows a front view of the stamp body of a third embodiment.

A fourth embodiment is shown in FIG. 9. In this embodiment, a stamp body 901 is shown which is attached to a handle 902 by attachment bar 903 which is inserted into an opening in top surface 951 and attachment bar 904 which is inserted into an opening in bottom surface 950. Also shown to be formed within side surface 951 is pin 905, pin 906, pin 907, and pin 908. These pins are separated by groove 920, groove 921, and groove 922. Similarly, side surface 950 has pin 909, pin 910, pin 911, and pin 912 formed within it. These pins are separated by groove 923, groove 924, and groove 925. The structure allows for rubberbands to be placed across the side surface of the stamp body 901 and to be affixed by means of the pins 905–912 and the corresponding grooves 920–925.

Figure 10:
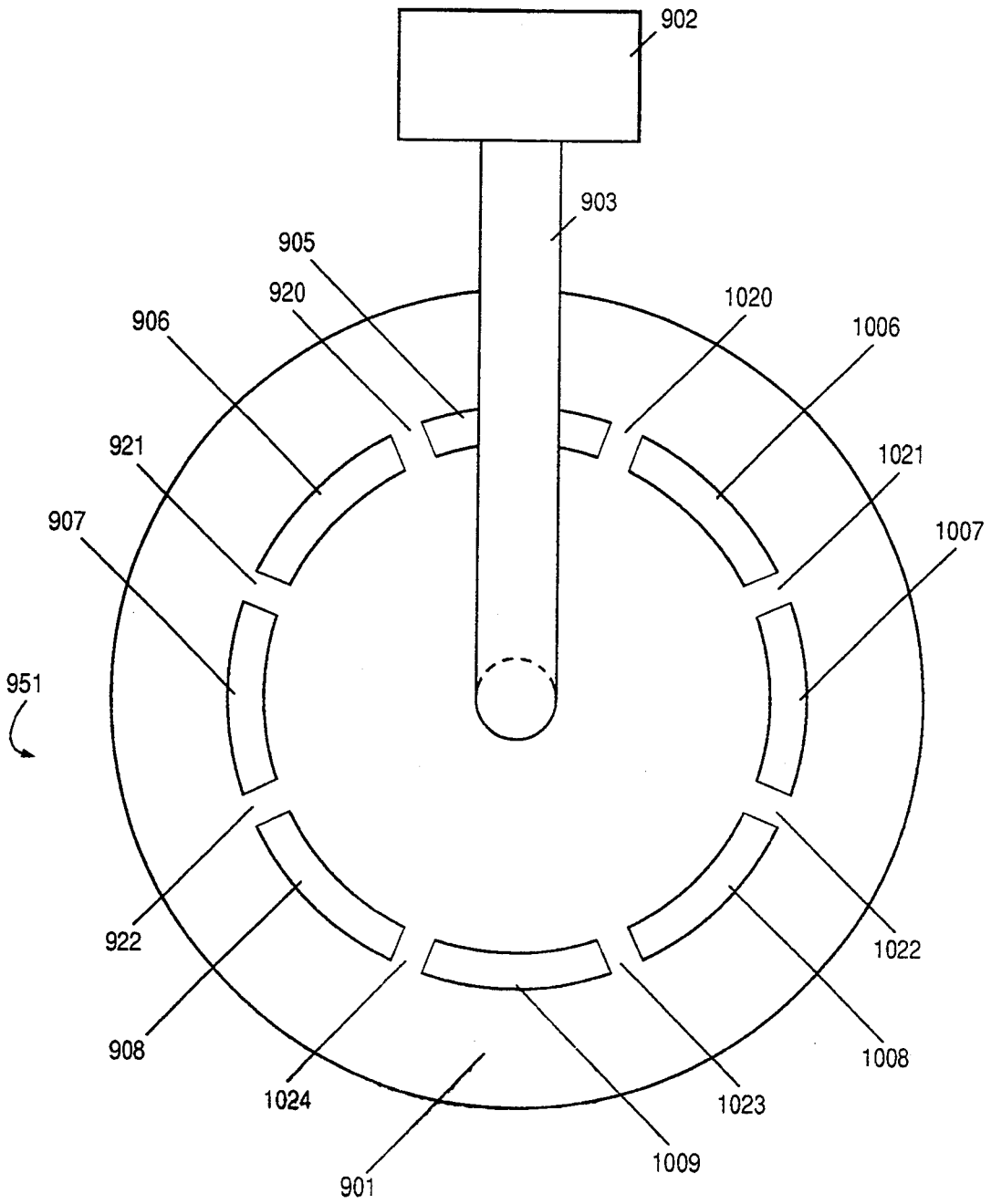
FIG. 10 is a side view of the stamp body of the third embodiment.

FIG. 10 shows a side view of the embodiment shown in FIG. 9, illustrating top surface 951 of that figure. This figure clearly shows pin 905, pin 906, pin 907, and pin 908 as well as groove 920, groove 921, and groove 922 shown in FIG. 9. Also shown are pins 1006–1009 and grooves 1020–1024. Rubberbands may be inserted into any of these grooves and/or around any of the pins so as to secure the rubberband to the body. The attachment bar 903 which is secured to the handle 902 allows the body 901 to freely rotate about an axis running through the center of the body 901. Note that any number of a different lengths and different configurations could be used to form a stamp body having a structure suitable for securing the rubberbands to the stamp body and for forming a stamp. Also, any of a number of different types of handles or mechanisms for securing the handle to the stamp body may also be used.

A fourth embodiment having a stamp body 1101 which has a circular bottom surface is shown. The stamp body, or stamp body is shown to include a handle 1100 having opening 1102 formed at the base of the handle for extending rubberbands through the opening. Cuts or grooves are made within the stamp body 1101 so as to form grooves 1120–1135 and pins 1103–1118. Not only may rubberbands be secured to the body by running the rubberbands within the grooves 1120–1135 and wrapping them around the pins 1103–1118, but also, the rubberbands may be wrapped around the handle 1100 or through the hole and around the handle so as to secure the rubberbands.

Figure 11:
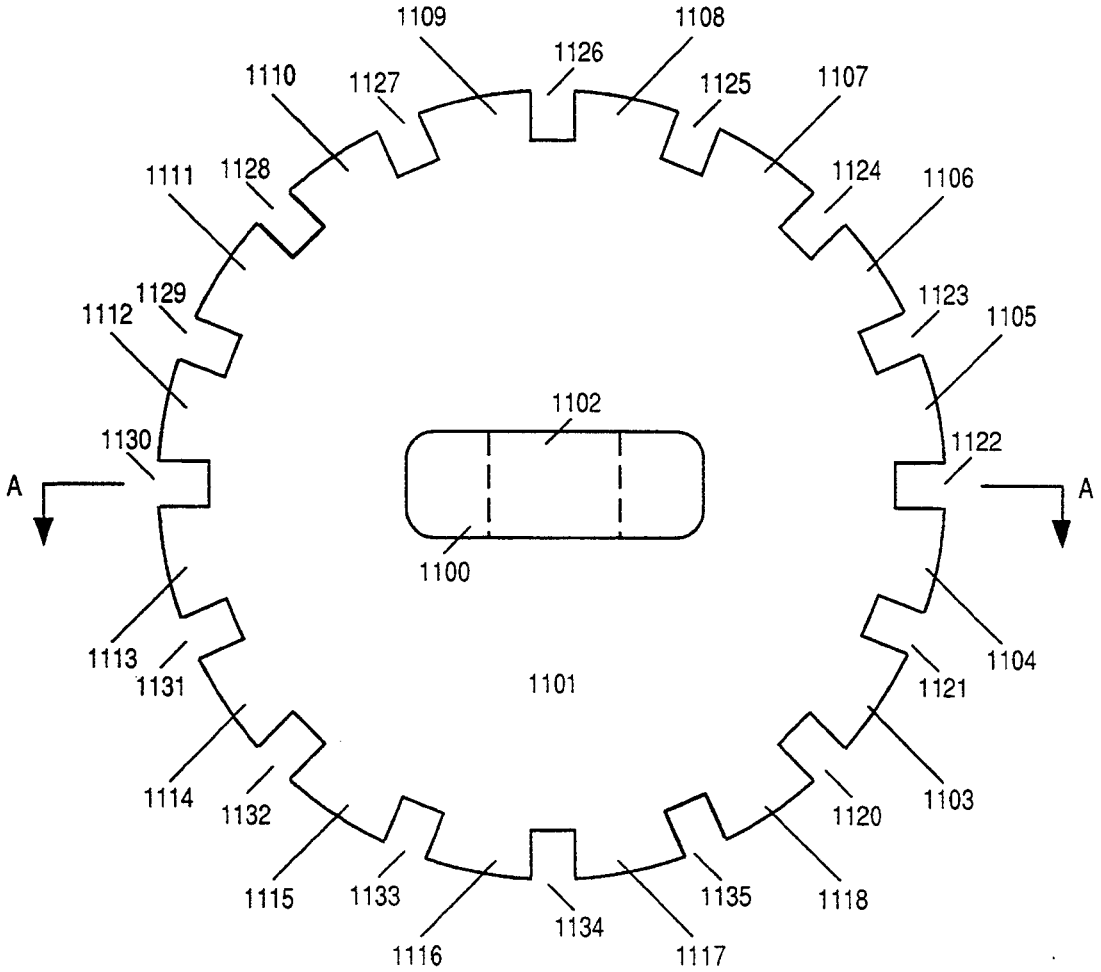
FIG. 11 is a top view of the stamp body of the fourth embodiment.
Figure 12:
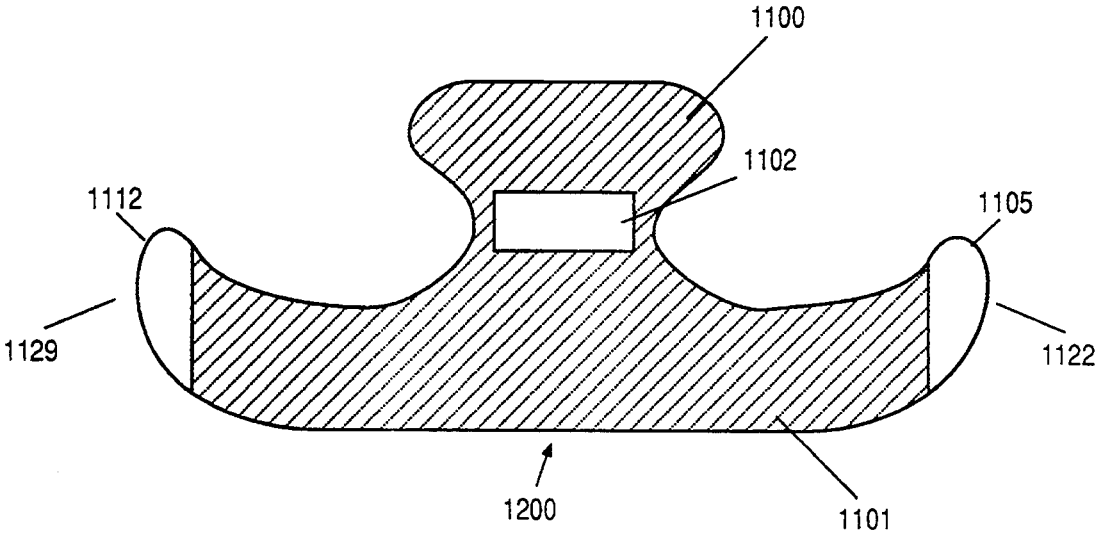
FIG. 12 is a side cross-section view of the stamp body of the fourth embodiment along axis A—A of FIG. 11.

FIG. 12 is a cross sectional view of the fourth embodiment along axis A—A shown in FIG. 11. This view clearly shows surface 1200 which has a circular shape. Also shown is the handle 1100 within which the opening 1102 is shown to be formed. Clearly, any of a number of different handle shapes could be used, and any of a number of different shapes and sizes of opening could be used. In order to form a stamp surface, rubberbands are placed within the pins and the corresponding grooves as was illustrated in the first three embodiments. For example, a rubberband could be secured on both sides of pin 1112 such that the rubberband passes through groove 1128 and groove 1129 and across the surface 1200 so as to form a stamp surface. The other end of the rubberband could then be secured by wrapping the rubberband through a groove such as groove 1122 and around the handle 1100. Also, a longer rubberband could be used which is secured within several different grooves and which passes over the surface 1200 number of times and which passes through the opening 1102. Clearly, any of a number of different shapes could be used to form a stamp similar to the stamp shown in fourth embodiment of the present invention. For example, an elliptical, rectangular, square, or triangular shape body may be used. Furthermore, a circular, elliptical, square, rectangular, or triangular body could be used which has a surface which is of a different geometrical shape. For example, a rectangular shaped stamp body having a circular bottom surface similar to surface 1200 shown in FIG. 12 could be used. The body could either taper into a circle, or a raised circular surface could be cut within the stamp body.

As can be seen by the four embodiments which have been illustrated, any of a number of different shapes could be used to form a stamp body. For example, trapezoids, triangles, pyramids, ellipses, etc. could also be used as shapes for stamp bodies and for stamp surfaces. The use of different geometrical patterns allows for many different stamp surfaces to be formed. Furthermore, nonuniform stamp surfaces could be used. These nonuniform surfaces could have shallow grooves and/or pins formed therein such that the rubberbands may bend around the given surface. This would allow for the formation of images having rounded contours.

Figure 13:
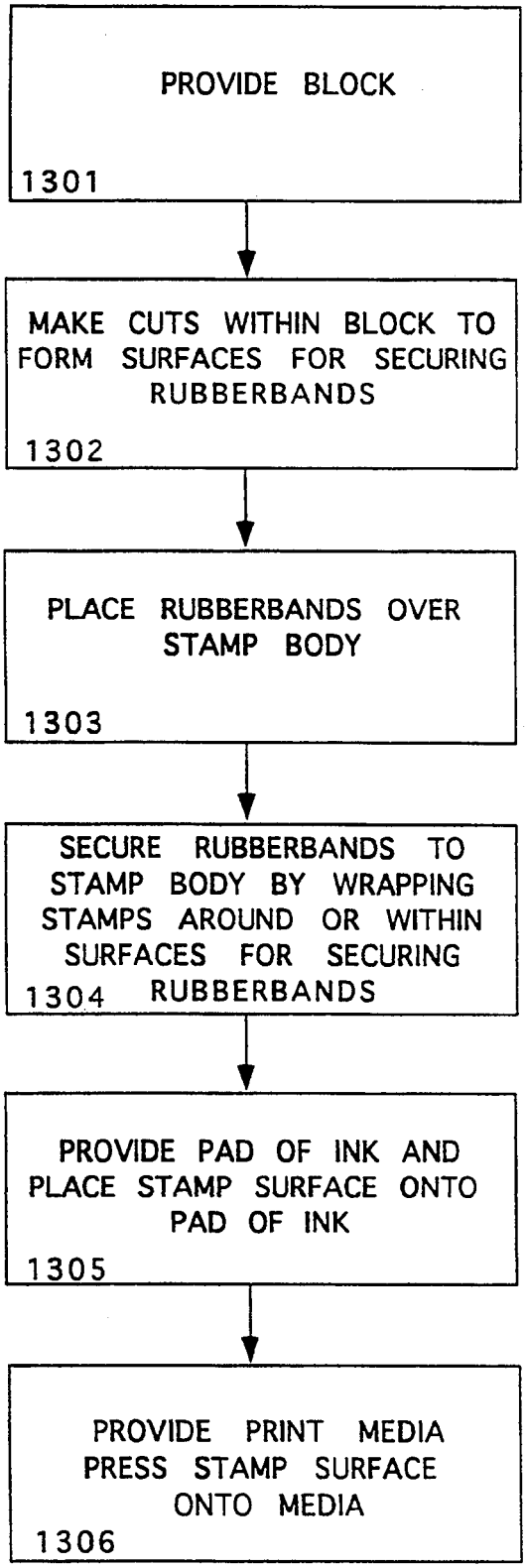
FIG. 13 is a schematic diagram illustrating the method for forming a decorative stamped image on a media.

The steps of forming a stamp and forming an image on a media are illustrated in FIG. 13. First the stamp body is created. This may be done by casting and or machining a metal or aluminum shape or by forming plastic within a mold. However, as the stamp body is herein illustrated with reference to the use of a wood form. First, as illustrated by block 1301 a wood form is provided. This wood form is then cut as illustrated by block 1302 to form surfaces for securing rubberbands. As illustrated by the embodiments shown in FIGS. 1–12, these surfaces may be ridges, pins or any of a number of other surfaces such as the surfaces of a handle. Furthermore, the block could have, for example, a square, cylindrical, rectangular or triangular shape. When forming a stamp body having a non-standard shape, additional machining, cutting, or drilling would be required to mark the body. As illustrated by block 1303, rubberbands are then placed onto the stamp body. Block 1304 shows that the rubberbands are secured to the stamp body by wrapping the rubberbands over the surfaces for securing the rubberbands. These four steps form an apparatus for stamping having at least one stamp surface, this apparatus for stamping or stamp may then be used to form an image.

As shown by block 1305, images may then be formed upon a media by taking the body having a stamp surface formed upon it, and placing the stamp surface into a pad of ink. Ink is then transferred from the ink pad onto the rubberbands which form the stamp surface. As shown by block 1306, an image is then formed onto a given media by pressing the stamp surface onto the media. The ink which is deposited onto the rubberbands is transferred onto the media so as to form an image corresponding to the shape of the stamp surface and the placement of the rubberbands. This step is shown by block 1306. A superior stamp surface may be achieved by using forms which have rounded edges and by stretching the rubberbands tightly so that they are firmly secured to the body. The rounding of the edges of the stamp surface assures that the edges do not easily accumulate ink during the inking process so as to transfer that ink to the media.

Typically, multiple stamps are placed on a given media. For example, with reference to the first embodiment of the present invention, stamps of all four side surfaces which form stamping surfaces may be placed onto a media. A form or shape may be made on the media by combining images formed by the different stamp surfaces. Images formed by the stamp surfaces of the stamp shown in the second embodiment of the present invention are ideal for forming borders of a printed image. Numbers and letters may also be formed by using the stamping surfaces of the stamp shown in the second embodiment.

Though almost any type of ink may be used in conjunction with the stamps shown in the first and second embodiment of the present invention, water-based inks are preferably used. Other printed effects may be achieved by using multi-colored stamp pads and by using a variety of colors of stamp pads. One of the advantages of the present invention is the fact that the rubberbands may be easily replaced with new rubberbands once they are discolored and worn from continued use. In addition, if one desires to make an image onto a media having a number of colors, the rubberband may be removed after the application of one color of image and new rubberbands may be replaced onto the stamp body. Then a second image having a different color may be deposited. In this manner one can assure that there is no mixing of ink. Furthermore, it is not necessary to either clean the stamp or to wait until the first application of ink dries on the stamp before applying a stamp containing ink of a different color as would be required by prior art stamps and stamping methods. However, the user may desire to include the residual ink in a subsequent image.

The described embodiments are merely illustrative of the many different configurations of the present invention which are possible. Therefore, it is to be understood that the particular embodiments shown and described by way of illustration are in no way intended to be considered limiting.

What is claimed is:

1. A stamp having a stamp body, said stamp body having a surface and a plurality of grooves formed within said stamp body for securing an elongated flexible member to said stamp body, said stamp further comprising a elongated flexible member, said elongated flexible member extended across said surface of said stamp body so as to form a stamp surface, a portion of said elongated flexible member passing through at least one of said grooves so as to secure said elongated flexible member to said stamp body and wherein said stamp body has a rectangular shape including a top surface, a bottom surface and four side surfaces and wherein at least one of said plurality of grooves is formed within said top surface and wherein at least one of said grooves is cut within said bottom surface.

2. The stamp of claim 1 further comprising a plurality of additional elongated flexible members, at least a portion of each of said elongated flexible members disposed within said grooves of said top surface and within said grooves of said bottom surface so as to secure said elongated flexible members to said stamp body.

3. The stamp of claim 2 wherein said stamp body includes a handle.

4. The stamp of claim 3 wherein three grooves are formed within said top surface of said stamp body in vertical direction, and wherein three grooves are formed within said bottom surface of said stamp body in a horizontal direction, and wherein three grooves are formed within said bottom surface of said stamp body in a vertical direction, and three grooves are formed within said bottom surface of said stamp body in a vertical direction.

5. The stamp of claim 3 wherein said stamp body has a cylindrical shape having said top surface, said bottom surface and a side surface, and wherein at least one of said grooves is formed within said top surface and wherein at least one of said grooves is formed within said bottom surface such that said elongated flexible member may be secured to said body by placing a portion of said elongated flexible member within said groove formed in said top surface and by placing a portion of said elongated flexible member within said groove formed in said bottom surface and such that said elongated flexible member may extend across said side surface of said body so as to form a round stamping surface.

6. The stamp of claim 5 wherein said cylindrical body includes an opening formed within the center of said top surface and an opening formed within the center of said bottom surface, said stamp further including a handle, a first handle attachment bar and a second handle attachment bar, said first handle attachment bar coupled to said handle and inserted into said opening in said top surface so as to rotatably couple said stamping body to said handle, said second handle attachment bar coupled to said handle and inserted into said opening in said bottom surface of said stamp body so as to rotatably couple said stamp body to said handle, wherein said stamp body is allowed to freely rotate about an axis running through said opening in said top surface of said stamp body and said opening in said bottom surface of said stamp body.

7. A stamp including a stamping surface, said stamp comprising:

a stamp body, said stamp body having a stamp supporting surface and a plurality of pegs formed within said stamp body, said stamp also including a elongated flexible member, said elongated flexible member placed onto said stamp body such that said elongated flexible member is disposed between at least two of said plurality of pegs formed with in said stamp body and such that a substantial length of said elongated flexible member extends across said stamp body and wherein said elongated flexible member extends across said stamp supporting surface of said stamp body so as to form a variable stamping surface and wherein said elongated flexible member is for generating designs and patterns dependent upon which pegs said elongated flexible member is disposed between.

8. A stamp as described in claim 7 wherein said stamp body comprises a first and a second surface and wherein said plurality of pegs are positioned within said first and said second surface and wherein said elongated flexible member is disposed across said first and said second surface and across a side surface wherein said side surface is said stamping surface.

9. A stamp as described in claim 8 wherein said elongated flexible member is a rubberband wrapped around said plurality of pegs and across said stamping surface wherein said rubberband may overlap itself, or another rubberband, across said stamp supporting surface.

10. A method of forming a stamp comprising:

providing a block having a top surface, a bottom surface, and at least one stamp supporting surface;

forming a first groove within said top surface of said block;

forming a second groove within said bottom surface of said block; and providing patterns and designs for printing by placing an elongated flexible member onto said block such that said elongated flexible member is secured within said groove formed within said top surface of said block and such that said elongated flexible member is secured within said groove formed within said bottom surface of said block, said elongated flexible member extending across said stamp supporting surface of said block so as to form a stamp surface wherein said designs and patterns are generated according to positions of said elongated flexible member across different portions of said stamp supporting surface of said block.

11. The method of forming a stamp of claim 10 wherein said elongated flexible member comprises a rubberband and wherein said block has a cylindrical shape wherein multiple surfaces of said block are exposed for providing a stamp supporting surface.

12. The method of forming a stamp of claim 10 wherein said block has a rectangular shape wherein multiple surfaces of said block are exposed for providing a stamp supporting surface.

13. The method of forming a stamp of claim 11 further comprising the steps of making a plurality of additional cuts within said top surface of said block and within said bottom surface of said block so as to form a plurality of additional grooves, some of said additional grooves cut within said top surface of said block in a horizontal direction and some of said grooves cut within said top surface of said block in a vertical direction so as to form a plurality of pins within said top surface of said block, and at least some of said grooves cut within said bottom surface of said block in a horizontal direction, and at least some of said grooves cut within said bottom surface of said block in a vertical direction so as to form a plurality of pins within said bottom surface of said block.

14. The method of forming a stamp of claim 11 further comprising the step of placing a second rubberband onto said stamp body, said second rubberband wrapped around said stamp body so as to overlie said first rubberband, and said stamp surface, a portion of said second rubberband extending through said grooves so as to secure said second rubberband to said stamp body.

15. The method of forming a stamp of claim 11 further comprising the step of attaching a stamp handle to said stamp.

16. The method forming a stamp of claim 11 wherein said step of forming a first groove further comprises the step of sawing said stamp body, and wherein said step of forming a second groove further comprises the step of sawing said stamp body.

17. A method of stamping comprising:

providing a stamp body having a stamp supporting surface, said stamp body having a plurality of grooves formed within said stamp body;

placing a elongated flexible member onto said stamp body such that said elongated flexible member is secured within at least one of said grooves formed within said stamp body and such that said elongated flexible member extends over said stamp supporting surface of said stamp body so as to create a stamping surface;

providing an ink pad, said ink pad having a surface and ink disposed therein;

pressing said stamp surface of said stamp onto said surface of said ink pad such that said ink is disposed onto said elongated flexible member;

providing a print media; and providing patterns and designs for printing by pressing said stamp body onto said media such that said ink is disposed onto said media wherein said designs and patterns are constituted according to positions of said elongated flexible member across different portions of said stamp supporting surface of said stamp body and wherein said elongated flexible member is allowed to cross and overlap itself.

18. The method of stamping of claim 17 wherein said stamp body is connected to a handle, said stamp body rotatably attached to said handle such that said stamp body may rotate about an axis running through said center of said stamp body, said step of pressing said stamp surface to said ink pad including the step of rolling said stamp body within said stamp pad, and said step of pressing said stamp body onto said media further including the step of rolling staid stamp body about said axis running through said center of said stamp body.

19. The method of stamping of claim 17 further comprising the step of providing another elongated flexible member wherein said elongated flexible member comprises a rubberband and wherein multiple surfaces of said stamp body are exposed for providing a stamp supporting surface and wherein said elongated flexible member is allowed to cross and overlap said another elongated flexible member.

20. The method of stamping of claim 19 wherein said stamp surface defines a pattern and wherein said step of pressing said stamp surface onto said media such that said ink is disposed onto said media forms a first image on said media, said method of stamping further comprising the step of forming a second image on said media by performing the additional steps of:

altering said pattern on said stamp surface by moving said rubberband, so as to create an altered stamp surface;

pressing said altered stamp surface onto said stamp pad such that said ink is disposed onto said rubberband; and pressing said altered stamp surface onto said media so a to create a second image on said media.

21. A stamp having a stamp body, said stamp body having a top surface and a bottom surface and a plurality of grooves formed within said top surface and said bottom surface of said stamp body for securing an elongated flexible member to said stamp body, said stamp further comprising said elongated flexible member, said elongated flexible member extended across surfaces of said stamp body so as to form a stamp surface, a portion of said elongated flexible member passing through at least one of said grooves so as to secure said elongated flexible member to said stamp body.

22. A stamp as described in claim 21 further comprising another elongated flexible member and wherein said elongated flexible member is elastic and wherein said elongated flexible member may overlap itself, or another said elongated flexible member, across said stamp surface.

23. A stamp as described in claim 21 wherein said elongated flexible member is a rubber band.

24. A stamp as described in claim 21 wherein said elongated flexible member is elastic and wherein said stamp body further comprises a side surface and wherein said elongated flexible member is disposed substantially in contact with said side surface and wherein said side surface is a stamping surface.

25. A stamp having a stamp body, said stamp body having a first surface, a second surface and a stamp surface and a plurality of grooves formed within said first surface and said second surface of said stamp body for securing an elongated flexible member to said stamp body, said stamp further comprising said elongated flexible member, said elongated flexible member extended across said first surface and said second surface of said stamp body and disposed over said stamp surface to form variable stamping designs thereover, a portion of said elongated flexible member passing between at least one of said grooves of said first surface so as to secure said elongated flexible member to said stamp body.

26. A stamp as described in claim 25 wherein said elongated flexible member is elastic and wherein said elongated flexible member constitutes said variable stamping designs according to positions of said elongated flexible member across said stamp surface.

27. A stamp as described in claim 25 wherein said elongated flexible member is elastic and wherein said stamp body further comprises a side surface and wherein said elongated flexible member is disposed substantially across said side surface and wherein said side surface is said stamp surface.

28. A stamp as described in claim 27 further comprising another elongated flexible member and wherein said elongated flexible member is disposed such that it overlaps itself, or said another elongated flexible member, across said stamp surface.

29. A stamp as described in claim 25 wherein said stamp body is a single body of substantially rectangular shape.

30. A stamp as described in claim 25 wherein said elongated flexible member comprises a thin elastic material having shapes cut therein such that when used as a stamp against a printing medium, said shapes are transferred onto said printing medium.

* * * * *